US010526112B2

(12) United States Patent
Stevens, Jr.

(10) Patent No.: US 10,526,112 B2
(45) Date of Patent: Jan. 7, 2020

(54) EXTENSION COLLAR FOR PAILS OF MIXABLE BUILDING MATERIAL

(71) Applicant: UNITED STATES GYPSUM COMPANY, Chicago, IL (US)

(72) Inventor: Richard B. Stevens, Jr., Crystal Lake, IL (US)

(73) Assignee: UNITED STATES GYPSUM COMPANY, Chicago, IL (US)

( * ) Notice: Subject to any disclaimer, the term of this patent is extended or adjusted under 35 U.S.C. 154(b) by 0 days.

(21) Appl. No.: 15/872,193

(22) Filed: Jan. 16, 2018

(65) Prior Publication Data

US 2018/0265253 A1 Sep. 20, 2018

Related U.S. Application Data

(60) Provisional application No. 62/473,067, filed on Mar. 17, 2017.

(51) Int. Cl.

| | |
|---|---|
| ***B65D 21/08*** | (2006.01) |
| ***B65D 25/28*** | (2006.01) |
| *B65D 8/08* | (2006.01) |
| *E04F 21/00* | (2006.01) |
| *E04G 21/02* | (2006.01) |

(52) U.S. Cl.

CPC ..... *B65D 21/083* (2013.01); *B65D 25/2867* (2013.01); *E04F 21/00* (2013.01); *E04G 21/025* (2013.01)

(58) Field of Classification Search

CPC ..... B65D 21/083; B65D 11/02; B65D 25/00; B65D 250/02; B65D 25/2867; B65D 25/32; E04F 21/00; E04F 32/025

USPC ..... 220/4.03, 4.26, 729

See application file for complete search history.

(56) References Cited

U.S. PATENT DOCUMENTS

| | | | | |
|---|---|---|---|---|
| 621,601 A * | 3/1899 | Conley | ..... | B65D 21/083 220/4.26 |
| 699,462 A | 5/1902 | Ehle | | |
| D797,225 S | 8/1905 | Reed | | |
| D947,922 | 2/1910 | Lewis | | |
| D44,392 S | 7/1913 | Whitney | | |
| 2,873,881 A | 2/1959 | Nichols | | |
| 2,878,956 A | 3/1959 | Chovanes | | |
| 3,252,635 A | 5/1966 | Rosenhan | | |
| 3,366,272 A * | 1/1968 | Ballmann | ..... | B65D 25/20 220/4.03 |

(Continued)

FOREIGN PATENT DOCUMENTS

CA 395786 A 4/1941

OTHER PUBLICATIONS

International Search Report from corresponding International Patent Application No. PCT/US2018/022108, dated Jun. 28, 2018.

*Primary Examiner* — J. Gregory Pickett
*Assistant Examiner* — Niki M Eloshway
(74) *Attorney, Agent, or Firm* — Greer, Burns & Crain, Ltd.; Pradip Sahu; Phillip T. Petti

(57) ABSTRACT

An extension collar is provided for use with a pail having an opening and containing mixable building material. The collar includes an annular body with an upper edge, an opposite lower edge, and a sidewall connecting the edges. In addition, the body has a diameter that is complementary to, and insertable into the opening of the pail such that upon insertion into the pail, the collar adds to a height of the pail.

11 Claims, 2 Drawing Sheets

(56) References Cited

U.S. PATENT DOCUMENTS

| | | | | |
|---|---|---|---|---|
| 4,083,466 | A | 4/1978 | McManaway | |
| 4,852,757 | A | 8/1989 | Gold | |
| D366,615 | S | 1/1996 | Gearin | |
| 6,164,481 | A | 12/2000 | Geeham | |
| 6,484,451 | B1 * | 11/2002 | Gavin | E02D 29/12 220/4.03 |
| 6,705,480 | B1 * | 3/2004 | Saddler | B44D 3/12 220/4.03 |
| 6,886,703 | B1 * | 5/2005 | Bonner | A47J 47/18 220/23.87 |
| 7,347,644 | B2 * | 3/2008 | Meyers | E02D 29/12 404/25 |
| 8,438,921 | B1 | 5/2013 | Bland | |
| 2002/0015357 | A1 | 2/2002 | Langevin, Jr. et al. | |
| 2006/0027575 | A1 * | 2/2006 | Lombardo | A47J 27/56 220/4.03 |
| 2007/0210081 | A1 | 9/2007 | Bongiornio | |
| 2010/0170909 | A1 | 7/2010 | Pollock | |
| 2015/0122835 | A1 * | 5/2015 | Gonzalez | B65D 21/083 222/105 |
| 2018/0134448 | A1 * | 5/2018 | Andreasen | B65D 21/0233 |

* cited by examiner

EXTENSION COLLAR FOR PAILS OF MIXABLE BUILDING MATERIAL

RELATED APPLICATION

This application claims 35 USC 119 priority from U.S. Provisional Application Ser. No. 62/473,067 filed Mar. 17, 2017, which is incorporated by reference herein.

BACKGROUND

The present invention relates generally to containers used for mixing wallboard joint compound or other products with water on a construction jobsite, and specifically to an improved structure for accommodating additional water for mixing, and for reducing splashing generated with use of a powered mixer.

In the construction industry, building materials such as paint, plaster, mortar, joint compound or other products are typically mixed on site in containers such as pails or buckets. In many such building materials, often a dry, powdered product is mixed with water on site. Depending on the amount of water added, joint compound is a highly viscous material and therefore is difficult to mix. The methods of mixing joint compound vary and typically include using a hand "masher" type mixer or a drill mixer. The hand "masher" type mixer includes an elongated handle with a generally planar, perforated, paddle-like working end. A user holds the handle of the hand "masher" and reciprocally moves the planar end up and down in a piston-like manner in the joint compound in a mashing motion to mix the joint compound. A drill mixer typically includes a power drill having an elongated drill bit with mixing blades at one end.

As is well known in the art, wallboard joint compound is provided to customers in two basic formats. The first type is a dry powdered format sold in bags or boxes and designed for being mixed on the jobsite with water to a desired consistency and viscosity. The second main format is known as ready mix joint compound, and is provided in a paste-like formulation that is ready to apply straight from the container. Ready mix joint compound is typically sold in plastic pails or tubs of various sizes.

Although they are formulated at the factory for being ready to apply straight from the container, in most cases, ready mixed joint compound products are combined with additional water and mixing prior to use, due to the preferences of professional applicators or operators, who prefer low viscosity joint compounds for easier spreading and faster drying of thinner coats. In some cases, products such as Taping Compound are formulated specifically for the addition of water at the jobsite.

A standard container for ready mix joint compound is a plastic 5-gallon pail, typically having a metal loop handle hooked into integral fittings on the pail as is well known in the art. It is customary for there to be approximately 1-inch of headspace or gap between the uppermost fill level of the joint compound and the top edge of the pail. In many cases, this limited amount of headspace is insufficient for accommodating the needed additional water, so at the time the joint compound is prepared for use on the jobsite, a few scoops of joint compound are removed and placed into another container to provide room in the pail for the additional water.

Drill mixing of the pail filled to near the top edge with water and compound is known to result in material flying out of the top of the pail during the drill mix procedure and splashing the surrounding area, and in some cases, the operator. The use of larger pails, or packaging less volume of joint compound into a pail are possible alternative options that have been considered, but in many cases have been negatively received by customers, who feel that they are not receiving all of the joint compound that they paid for.

Accordingly, there is a need for an improved joint compound container which addresses the above-listed drawbacks.

SUMMARY

The present collar is designed for use with a standard pail containing a water-mixable building material such as wallboard joint compound, and once installed, effectively raises the height of the pail to accommodate additional water, and to reduce splashing generated by the use of power mixers. In the preferred embodiment, the present collar adds approximately 3-5 inches to the height of the pail. A feature of the present collar is that it is removable from the pail, so that upon consumption of the contents of the pail, the collar is installable upon a new pail. In the preferred embodiment, the sidewall is provided with at least one radially extending strengthening rib, and the ribs include a plurality of axially spaced ribs located between the upper edge and the lower edge.

Appropriate clips are contemplated for securing the collar in place upon the pail during use. In addition, a seal is also optionally provided for preventing leaks between the collar and the pail. Another optional feature is a mount constructed and arranged for accommodating a powered mixer.

More specifically, an extension collar is provided for use with a pail having an opening and containing mixable building material. The collar includes an annular body with an upper edge, an opposite lower edge, and a sidewall connecting the edges. In addition, the body has a diameter that is complementary to, and insertable into the opening of the pail such that upon insertion into the pail, the collar adds to a height of the pail.

In another embodiment, a combination pail containing mixable building material and an extension collar is provided for selectively increasing a height of the pail. The combination includes a pail having an opening; and an extension collar including an annular body with an upper edge, an opposite lower edge, and a sidewall connecting the edges. The body has a diameter being complementary to, and insertable into the opening of the pail such that upon insertion into the pail, the collar adds to a height of the pail in the range of 3-5 inches.

DETAILED DESCRIPTION

Figure 1:
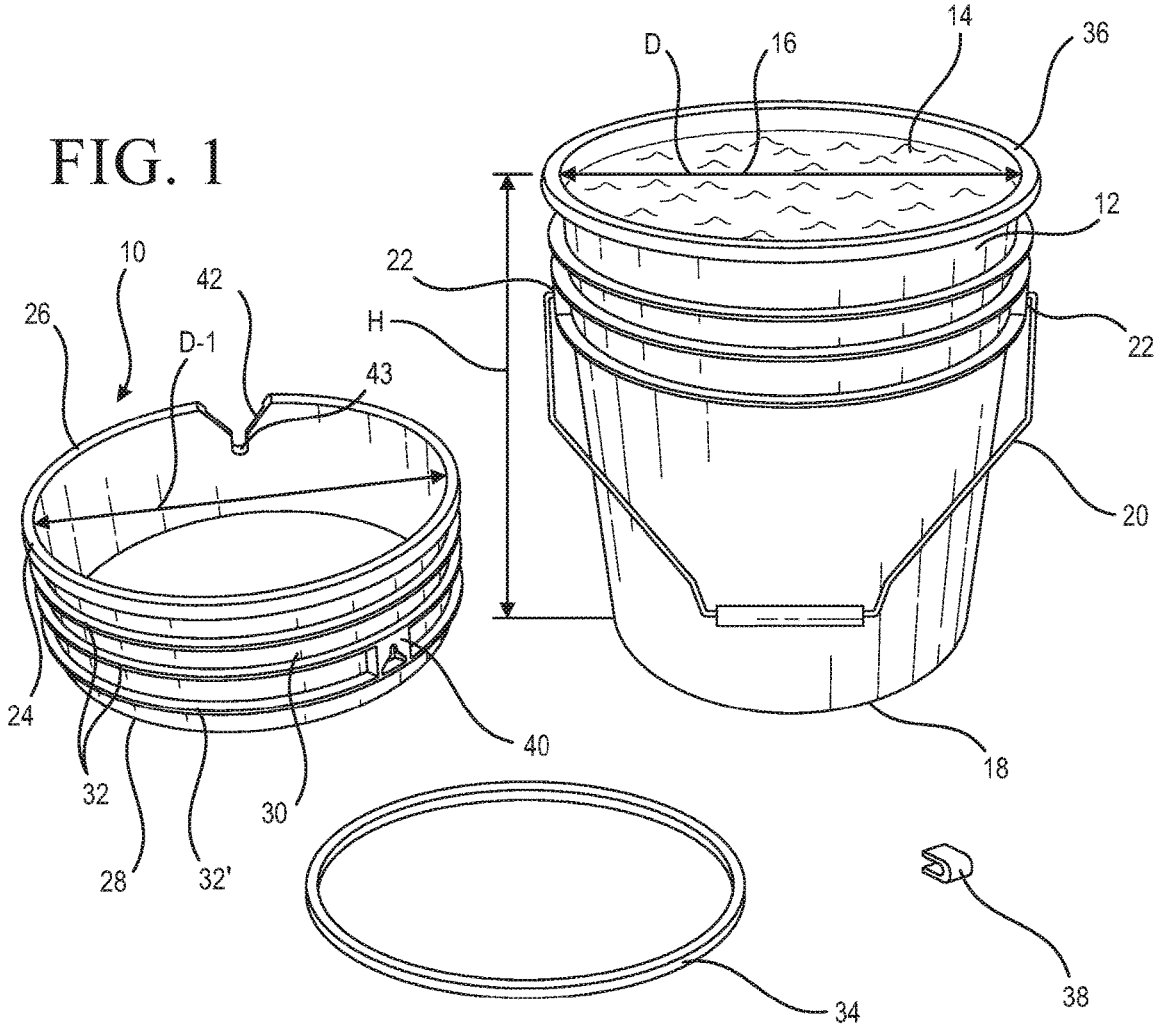
FIG. 1 is a top perspective view of a standard pail with the present collar located beside it prior to installation.

Referring now to FIGS. 1-4, the present extension collar is generally designated 10 and is constructed and arranged for use with a pail, generally designated 12 having an opening 14 and containing mixable building material 16. As is known in the art, the pail 12 has a bottom 18 opposite the opening 14, and a handle 20 received in integral handle mounts 22. The pail 12 has a height "H" and a diameter "D".

While the sizes and capacities may vary to suit the application, the preferred pail 12 has a capacity of 5 gallons, a height "H" of approximately 15 inches, and a diameter "D" of approximately 12 inches.

Turning now to the present collar 10, an annular body 24 has a diameter "D-1" which is complementary to, and preferably identical to the pail diameter "D." Also included on the collar 10 are an upper edge 26, an opposite lower edge 28, and a sidewall 30 connecting the edges. In the preferred embodiment, the collar 10 is a unitary piece, preferably produced by injection molding or similar technology. The preferred plastic used for manufacturing the collar 10 is the same used for producing the pail 12. Such materials include HDPE, ABS and the like as are well known in the molding art.

A main feature of the present collar 10 is that, upon insertion into the opening 14, additional height is provided to the pail 12 for accommodating the addition of supplemental water for mixing with the existing material 16. In the preferred embodiment, the collar 10 has a height "H-1" (FIG. 2) that upon insertion, adds on the order of 3-5 inches to the height "H." To enhance the structural stability of the collar 10, at least one and preferably a plurality of radially extending strengthening ribs 32 are provided to the sidewall 30. It is contemplated that there is a plurality of such ribs 32 axially spaced along the sidewall located between the upper edge 26 and the lower edge 28.

Figure 2:
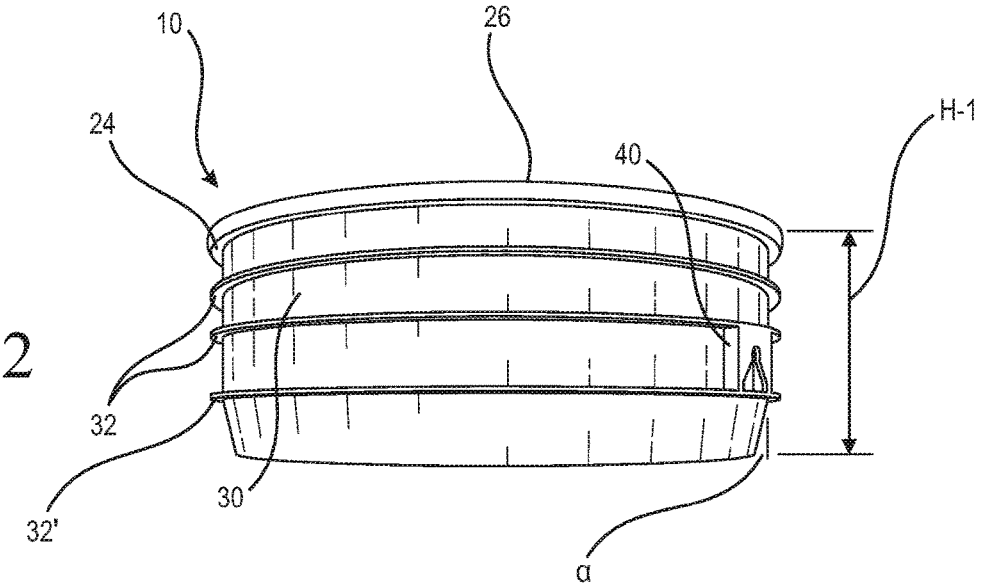
FIG. 2 is a side elevation of the present collar.

Referring now to FIG. 2, the lower edge 28 of the collar is tapered below a lowermost rib 32' for facilitating insertion into, and withdrawal from the pail 12. An angle $\alpha$ of the taper of the lower edge 28 is contemplated as varying to suit the application, but is preferably in the general range of 5-30°.

Referring now to FIG. 1, to prevent leaks between the collar 10 and the pail, the collar is optionally provided with an annular seal 34 constructed and arranged for placement between the lowermost rib 32' and a rim 36 formed at the opening 14 of the pail 12. Preferably, the seal is held by friction fit to the tapered lower edge 28, however chemical adhesives, or also integral molding of the seal to the collar 10 is contemplated. Once in place, the seal 34 prevents leaks between the collar 10 and the pail 12.

Figure 4:
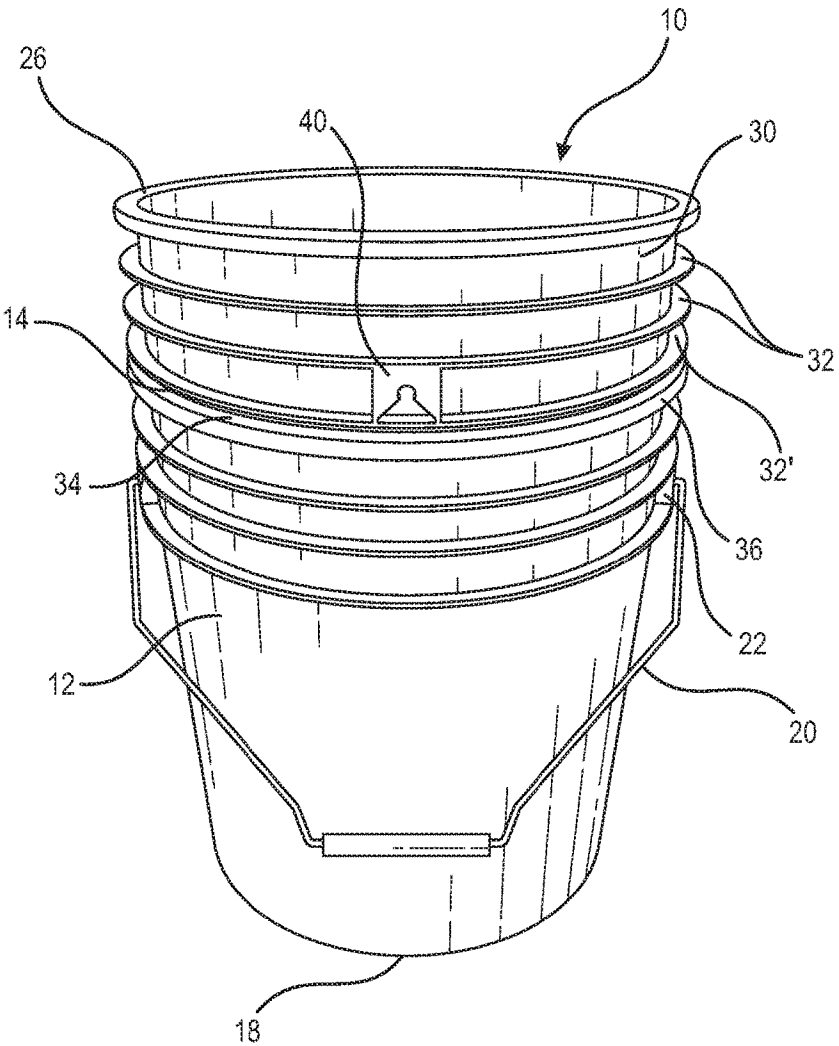
FIG. 4 is a side perspective view of the present collar installed on the pail.

Another feature of the collar 10 is at least one and preferably several optional clips 38 which clamp the collar to the rim 36 of the pail 12, preferably by engaging the rim and the lowermost rib 32' which are closely associated with each other upon installation of the collar upon the pail (FIG. 4). The clips 38 are made of plastic, metal or the like, and are contemplated as having a variety of configurations, as long as the collar 10 is releasably secured to the pail 12. While the depicted clip 38 is shown as a separate piece, it is also contemplated that the clips are fastened to the collar 10, using fasteners, adhesives or the like, or are molded to the collar.

As seen in FIGS. 1-4, the collar 10 also features a pair of handle mounts 40 located on the sidewall 30. The collar handle mounts 40 are similar in construction and arrangement to the pail handle mounts 22. Preferably, the collar handle mounts 40 are located between one of the ribs 32 and the lowermost rib 32'. Installation of a handle 20 into the collar handle mounts 40 facilitates the removal of the collar 10 from the pail 12.

Referring now to FIG. 1, another feature of the present collar 10 is an integral mount or cradle 42 associated with said upper end for receiving a powered mixer as is known in the art. The mount 42 is formed as a generally "V"-shaped notch cut into and depending from the upper edge 26 for receiving a powered mixer, the notch having an apex 43 with a locating recess. The mixer, in many cases a power drill with an elongated mixer bit, is used by the operator to more thoroughly mix the building material contents 16 with supplemental water for creating a desirable slurry. Once mixed, the slurry is readily spreadable upon walls or ceiling of a structure under construction.

Figure 3:
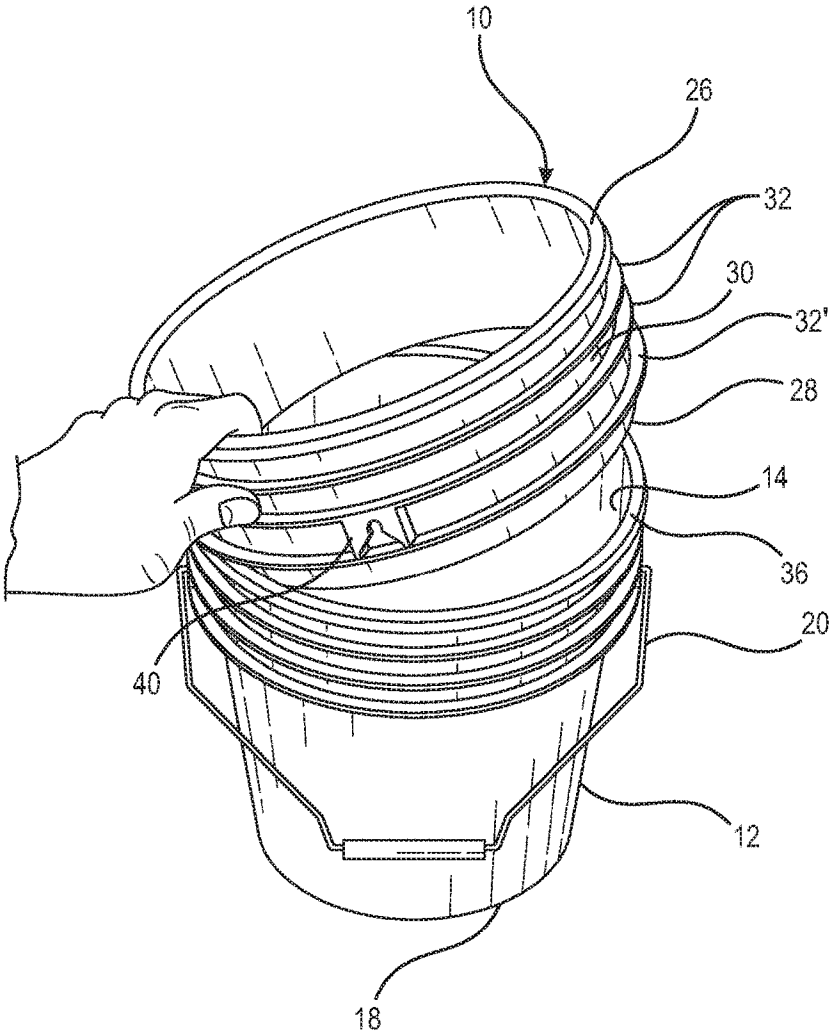
FIG. 3 is a top perspective view of the present collar being installed upon the pail.

In use, the operator inserts the collar 10 upon the pail 12 so that the lower edge 28 engages the opening (FIG. 3). Once seated (FIG. 4) and preferably sealed by the seal 34 and held in place by the clips 38, the operator is free to add supplemental water, and then to perform mixing, either by hand or with a powered mixer accommodated in the mount 42.

While particular embodiments of the present extension collar for use with pails of mixable building material have been shown and described, it will be appreciated by those skilled in the art that changes and modifications may be made thereto without departing from the invention in its broader aspects and as set forth in the following claims.

What is claimed is:

1. An extension collar for use with a pail having an opening and containing mixable building material, comprising:

an annular body with an upper edge, an opposite lower edge, and a sidewall connecting said edges;

a plurality of axially spaced ribs radially projecting from an exterior of said sidewall and located between said upper edge and said lower edge;

at least one handle mount on said sidewall being located between a lowermost one of said axially spaced ribs and a next adjacent one of said ribs;

an annular seal associated with said lower edge and below a lowermost rib of said plurality of axially spaced ribs for sealingly engaging the opening of the pail;

said body having a diameter being complementary to, and insertable into the opening of the pail such that upon insertion into the pail, said collar adds to a height of the pail.

2. The extension collar of claim 1, wherein said body is dimensioned to add to the height of the pail in the range of 3-5 inches.

3. The extension collar of claim 1, further including at least one clip on said sidewall for releasably clamping said collar to the pail by engaging said lowermost rib and a rim of the pail.

4. The extension collar of claim 1, wherein said lower end is tapered to slidingly and releasably engage the opening of the pail, an angle of said taper being in the range of 5-30°.

5. The extension collar of claim 1, further including a mount-formed as a generally "V"-shaped notch cut into and depending from said upper edge for receiving a powered mixer.

6. A combination pail containing mixable building material and an extension collar for selectively increasing a height of said pail, comprising:

a pail having an opening;

an extension collar including an annular body with an upper edge, an opposite lower edge, and a sidewall connecting said edges;

said body having a diameter being complementary to, and insertable into said opening of the pail such that upon insertion into said pail, said collar adds to a height of said pail in the range of 3-5 inches; and a mount formed as a generally "V"-shaped notch cut into and depending from said upper edge for receiving a powered mixer.

7. The combination of claim 6, further including an annular seal associated with said lower edge for sealing engaging said opening of said pail.

8. The combination of claim 6, further including at least one clip on said sidewall for releasably clamping said collar to said pail by engaging said lowermost rib and a rim of the pail.

9. The combination of claim 6, wherein said lower end is tapered to slidingly and releasably engage said opening of said pail.

10. An extension collar for use with a pail having an opening and containing mixable building material, comprising:

an annular body with an upper edge, an opposite lower edge, and a sidewall connecting said edges;

a plurality of axially spaced ribs located between said upper edge and said lower edge;

an annular seal associated with said lower edge and below a lowermost rib of said plurality of axially spaced ribs for sealingly engaging the opening of the pail;

said body having a diameter being complementary to, and insertable into the opening of the pail such that upon insertion into the pail, said collar adds to a height of the pail;

at least one handle mount on said sidewall being located between said lowermost rib and a next adjacent one of said ribs;

at least one clip on said sidewall for releasably clamping said collar to the pail by engaging said lowermost rib and a rim of the pail; and a mount formed as a generally "V"-shaped notch cut into and depending from said upper edge for receiving a powered mixer.

11. The extension collar of claim 10, wherein said lower end is tapered to slidingly and releasably engage the opening of the pail, an angle of said taper being in the range of 5-30°.

* * * * *